US005416933A

United States Patent [19]

Bernard

[11] Patent Number: 5,416,933

[45] Date of Patent: May 23, 1995

[54] APPARATUS FOR SPRAYING WATER IN A CHILD'S WADING POOL TO SIMULATE A TYPHOON

[76] Inventor: Charles R. Bernard, 109 Bicentennial Ct., Webster City, Iowa 50595

[21] Appl. No.: 206,331

[22] Filed: Mar. 7, 1994

[51] Int. Cl.[6] ..... A47K 3/23

[52] U.S. Cl. ..... 4/599; 4/612

[58] Field of Search ..... 4/599–603, 4/612, 615, 616

[56] References Cited

U.S. PATENT DOCUMENTS

| | | | |
|---|---|---|---|
| 585,439 | 6/1897 | Hooper | 4/601 |
| 743,623 | 11/1903 | Dinneen | 4/601 |
| 3,629,875 | 12/1971 | Dow et al. | 4/599 |
| 5,216,763 | 6/1993 | Grenier | 4/599 X |
| 5,311,620 | 5/1994 | Ratje | 4/603 X |

*Primary Examiner*—Charles E. Phillips

[57] ABSTRACT

A new and improved apparatus for spraying water in a child's wading pool to simulate a typhoon comprising a water spraying assembly which has a first tube in a circular configuration forming a first ring of an enlarged diameter. A plurality of inwardly directed spray heads on the first ring and first fluidic coupling components are secured to the first ring. A second tube in a circular configuration forms a second ring of a reduced diameter with radially extending tubes terminating in a central sprinkler head coupled with respect thereto. Second fluidics components are secured to the second ring and a generally vertically oriented tube for coupling the fluidic components of the first ring and the second ring.

1 Claim, 3 Drawing Sheets

APPARATUS FOR SPRAYING WATER IN A CHILD'S WADING POOL TO SIMULATE A TYPHOON

BACKGROUND OF THE INVENTION

1. Field of the Invention

The present invention relates to apparatus for spraying water in a child's wading pool to simulate a typhoon and more particularly pertains to simulating a typhoon or other extreme condition of weather through the use of water sprays in a child's wading pool.

2. Description of the Prior Art

The use of shower heads and other water spraying devices is known in the prior art. More specifically, shower heads and other water spraying devices heretofore devised and utilized for the purpose of spraying water for one purpose or another are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,539 to Larsen discloses an outdoor gym set with plural water spray heads.

U.S. Pat. No. 3,831,852 to Stillman, Jr., discloses a fountain spray system for swimming pools.

U.S. Pat. No. 3,877,644 to Cockman discloses a sprinkler head and game apparatus.

U.S. Pat. No. 4,235,378 to Melin et al discloses a water play toy.

U.S. Pat. No. 4,416,420 to Thompson discloses a portable fountain for pools or spas.

Lastly, U.S. Pat. No. 4,550,876 to Kulesza et al discloses a sprinkler toy.

In this respect, the apparatus for spraying water in a child's wading pool to simulate a typhoon according to the present invention substantially departs from the conventional concepts and designs of the prior art, and in doing so provides an apparatus primarily developed for the purpose of simulating a typhoon or other extreme condition of weather through the use of water sprays in a child's wading pool.

Therefore, it can be appreciated that there exists a continuing need for new and improved apparatus for spraying water in a child's wading pool to simulate a typhoon which can be used for simulating a typhoon or other extreme condition of weather through the use of water sprays in a child's wading pool. In this regard, the present invention substantially fulfills this need.

SUMMARY OF THE INVENTION

In view of the foregoing disadvantages inherent in the known types of shower heads and other water spraying devices now present in the prior art, the present invention provides an improved apparatus for spraying water in a child's wading pool to simulate a typhoon. As such, the general purpose of the present invention, which will be described subsequently in greater detail, is to provide a new and improved apparatus for spraying water in a child's wading pool to simulate a typhoon and method which has all the advantages of the prior art and none of the disadvantages.

To attain this, the present invention essentially comprises a new and improved apparatus for spraying water in a child's wading pool to simulate a typhoon comprising a water spraying assembly which has a first tube in a circular configuration forming a first ring of an enlarged diameter. A plurality of inwardly directed spray heads on the first ring and first fluidic coupling components are secured to the first ring. A second tube in a circular configuration forms a second ring of a reduced diameter with radially extending tubes terminating in a central sprinkler head coupled with respect thereto. Second fluidic components are secured to the second ring and a generally vertically oriented tube for coupling the fluidic components of the first ring and the second ring. A shelter assembly for the spraying assembly. The shelter assembly includes a circular wading pool with pneumatic peripheral walls adapted to receive water in the lower extent thereof. The wading pool has upwardly directing side walls in a generally parabolic configuration with a circular opening at the upper extent thereof and transparent panels in the side walls between the upper and lower extents with coupling means to attach the second ring to an intermediate extent of the interior of the side walls and to attach the first ring adjacent to the opening. A water handling assembly includes a pump positionable in the wading pool with a fluidic line coupled to the fluidic components of the first and second rings to effect the flow of water from the wading pool to the rings for recirculating the water from the child's wading pool to the heads in a continuous and automatic cycle of operation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved apparatus for spraying water in a child's wading pool to simulate a typhoon which have all the advantages of the prior art shower heads and other water spraying devices and none of the disadvantages.

It is another object of the present invention to provide new and improved apparatus for spraying water in a child's wading pool to simulate a typhoon which may be easily and efficiently manufactured and marketed.

It is further object of the present invention to provide new and improved apparatus for spraying water in a child's wading pool to simulate a typhoon which are of durable and reliable constructions.

An even further object of the present invention is to provide new and improved apparatus for spraying water in a child's wading pool to simulate a typhoon which are susceptible of a low cost of manufacture with regard to both materials and labor, and which accordingly are then susceptible of low prices of sale to the consuming public, thereby making such apparatus for spraying water in a child's wading pool to simulate a typhoon economically available to the buying public.

Still yet another object of the present invention is to provide new and improved apparatus for spraying water in a child's wading pool to simulate a typhoon which provide in the apparatuses and methods of the prior art some of the advantages thereof, while simultaneously overcoming some of the disadvantages normally associated therewith.

Still another object of the present invention is to simulate a typhoon or other extreme condition of weather through the use of water sprays in a child's wading pool.

Lastly, it is an object of the present invention to provide new and improved apparatus for spraying water in a child's wading pool to simulate a typhoon comprising a water spraying assembly which has a first tube in a circular configuration forming a first ring of an enlarged diameter. A plurality of inwardly directed spray heads on the first ring and first fluidic coupling components are secured to the first ring. A second tube in a circular configuration forms a second ring of a reduced diameter with radially extending tubes terminating in a central sprinkler head coupled with respect thereto. Second fluidics components are secured to the second ring and a generally vertically oriented tube for coupling the fluidic components of the first ring and the second ring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
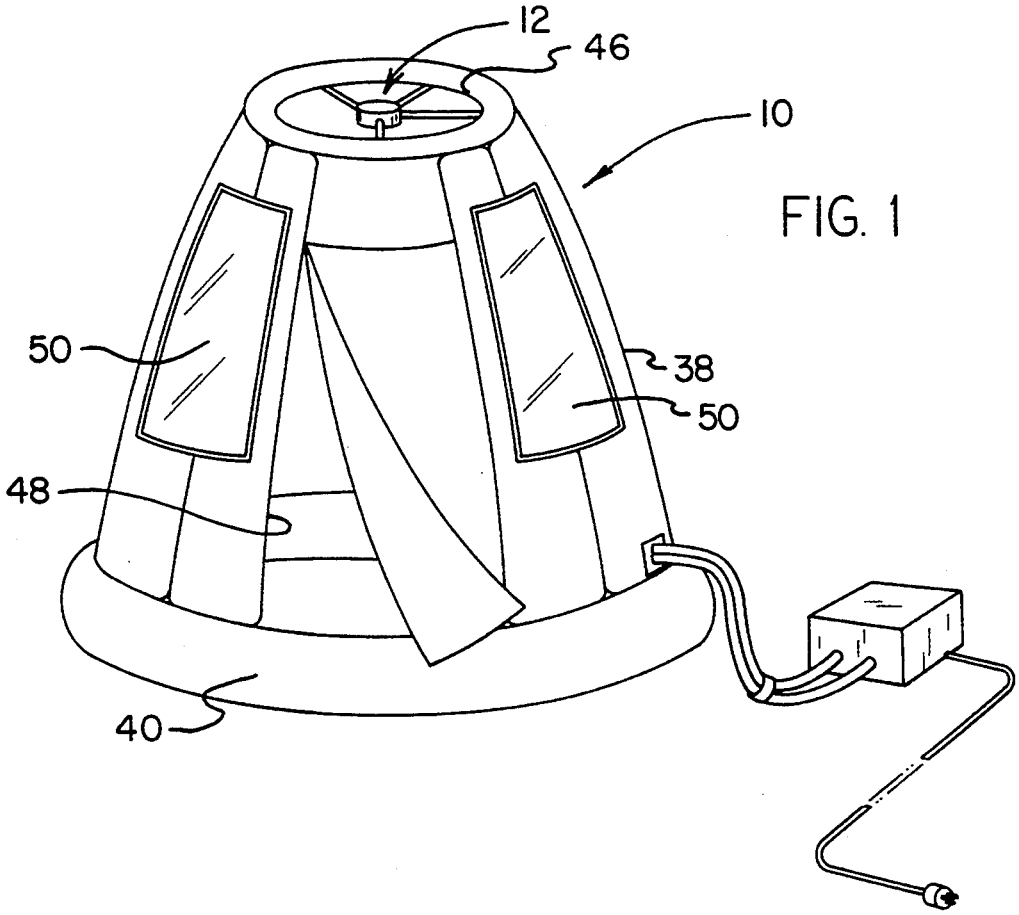
FIG. 1 is a perspective illustration of the preferred embodiment of the apparatus for spraying water in a child's wading pool to simulate a typhoon constructed in accordance with the principles of the present invention.
Figure 2:
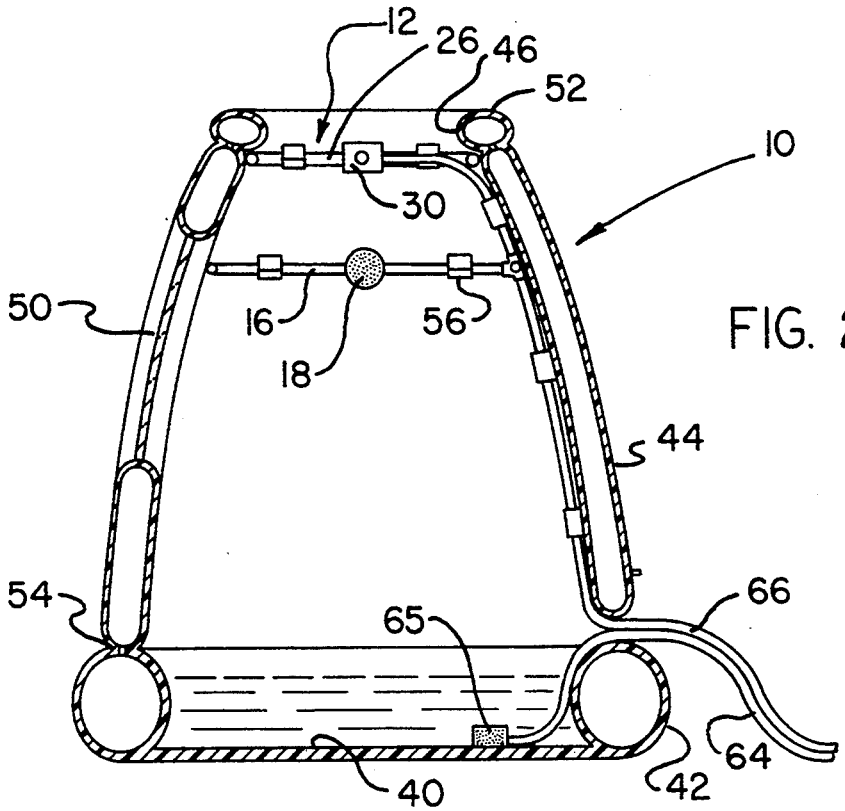
FIG. 2 is a cross sectional view of the device shown in FIG. 1 taken vertically through the center line thereof.
Figure 3:
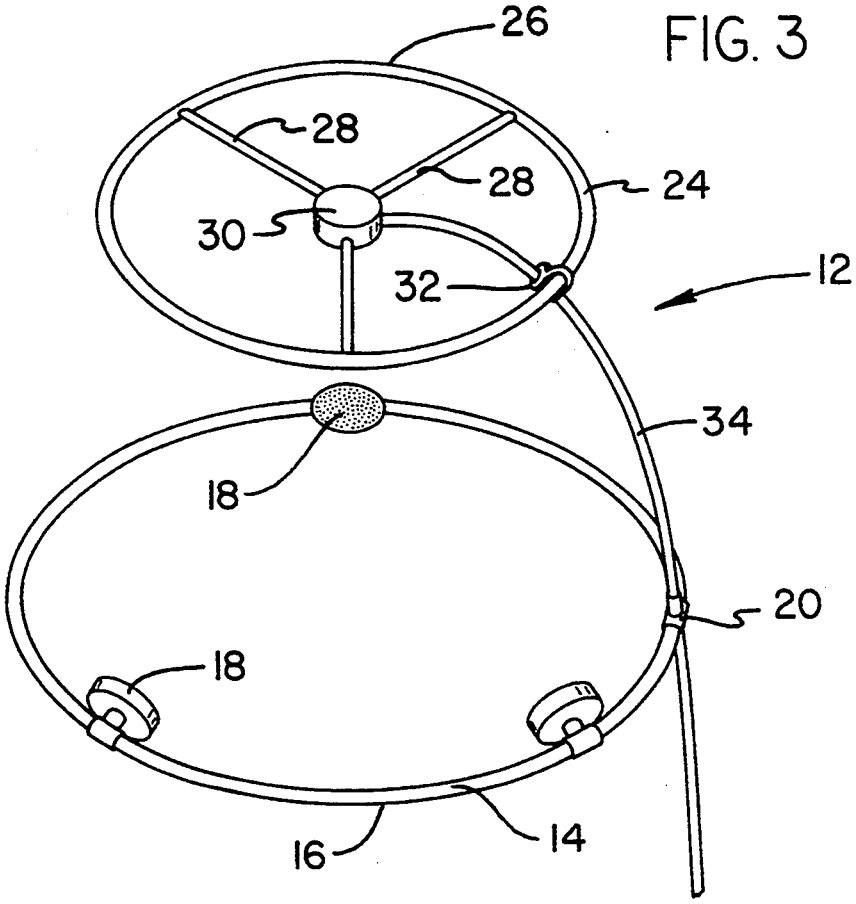
FIG. 3 is a perspective illustration of the water spraying components of the device of FIGS. 1 and 2.
Figure 4:
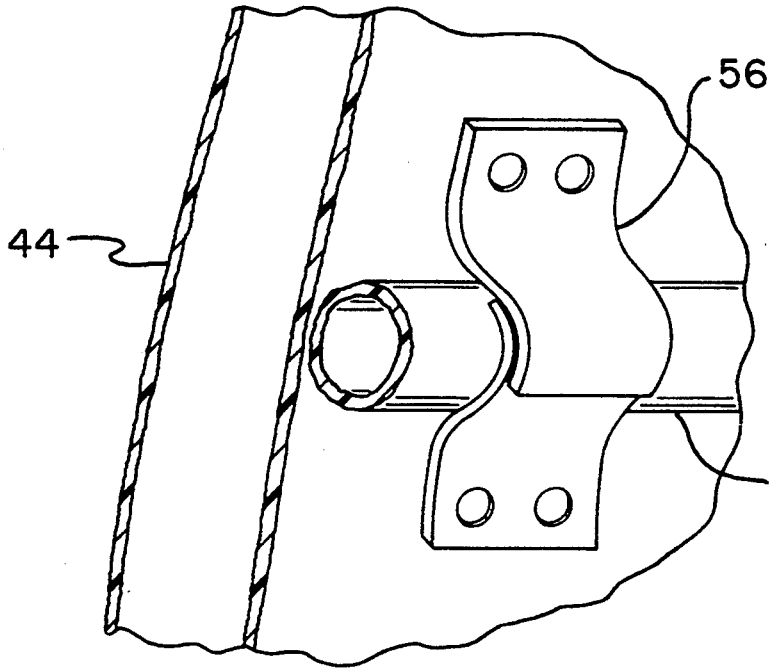
FIG. 4 is an enlarged perspective view of the coupling mechanisms between the sheltering components and the spraying components.
Figure 5:
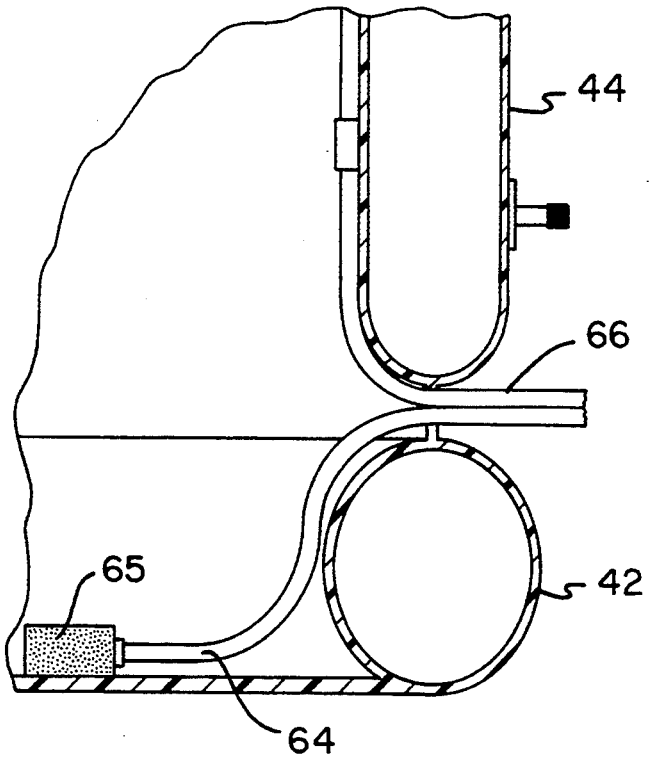
FIG. 5 is an enlarged sectional view of the lower components of the device shown in the prior Figures.
Figure 6:
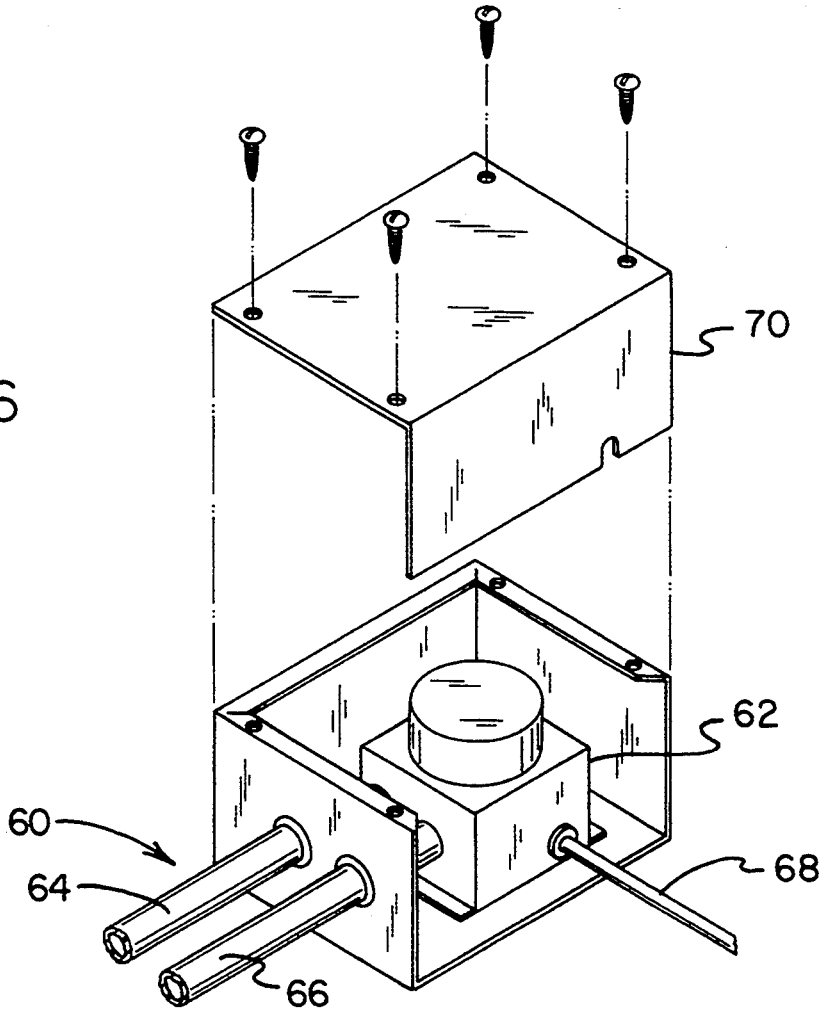
FIG. 6 is an enlarged exploded perspective showing of the pump of FIG. 5.

With reference now to the drawings, and in particular to FIG. 1 thereof, the preferred embodiment of the new and improved apparatus for spraying water in a child's wading pool to simulate a typhoon embodying the principles and concepts of the present invention and generally designated by the reference numeral 10 will be described.

The present invention, the new and improved apparatus for spraying water in a child's wading pool to simulate a typhoon is a system 10 comprised of a plurality of components and assemblies. Each of the components and assemblies is individually configured and correlated one with respect to the other to attain the desired objectives. The assemblies in their broadest context include a water spray assembly, a shelter assembly, and a water handling assembly.

More specifically, the water spray assembly 12 is comprised of a first tube 14. The first tube is of a circular configuration. It is formed into a first ring 16 of an enlarged diameter. Operatively coupled with respect to the tube of the first ring are a plurality of spray heads 18. The spray heads are inwardly directed and with a slightly downward orientation to spray water on a person therebetween. Also on the first tube are first fluidic coupling components 20 secured thereto.

Also as part of the water spray assembly is a second tube 24. The second tube is in a circular configuration. It also forms a ring 26, a second ring, but of a reduced diameter as compared to the first ring. The second ring has tubes 28 extending radially inwardly therefrom. The radially extending tubes terminate in a central sprinkling head 30. Such sprinkling head is coupled fluidically to the radially extending tubes and the second ring. Second fluidic components 32 are secured to the second ring in generally vertical alignment with the coupling components of the first ring. In addition, a generally vertically extending or oriented tube 34 is adapted to fluidically couple the fluidic components of the first ring and the second ring. The rings when operating together provide a spray of water downwardly from the second ring and inwardly from the first ring to simulate, on a small scale, a typhoon for the entertainment of children located in operative association with the sprinkler head.

The next assembly is the shelter assembly 38. The shelter assembly is for supporting the rings of the water spraying assembly and to preclude water from being lost from the system to the atmosphere. The shelter assembly includes a circular wading pool 40. The wading pool has pneumatic peripheral walls 42. As such, the wading pool is adapted to receive water in the lower extent thereof as sprayed by the water spraying assembly. The wading pool also has upwardly directed side walls 44. Such side walls are in a generally parabolic configuration. They are also pneumatic with a valve to render them self supporting. A circular opening 46 is located at the upper extent thereof. In addition, a separable opening 48 is located along a side wall for the entrance and exit of children to within the shelter assembly to enjoy the action of the water from the spraying assembly. In addition, for allowing parents to view the action of the water against the child therein, there are provided transparent panels 50 in the side walls. Such transparent panels are located between the upper and lower extents 52 and 54. In addition, coupling components 56 are secured to the interior surface of the side walls to attach the second ring to an intermediate extent of the interior of the side walls. The coupling components will also function to attach the first ring adjacent to the opening.

The last element of the system 10 is the water handling assembly 60. The water handling assembly includes a pump 62. Such pump has a line 64 positionable on the floor of the wading pool. An aperture shield 65 covers the free end of the suction line 64 for added safety. Also included is a fluidic line 66 coupled to the fluidic components of both the first and second ring. The fluidic lines in combination with the pump acts to effect the flow of water from the wading pool to the rings. This acts to recirculate the water from the child's wading pool to the heads, both the sprinkler head of the second ring and the spray heads of the first ring. This action operates in a continuous and automatic cycle of operation. An electrical line 68 from the pump in the wading pool is adapted to couple the pump to a source of electrical potential to operate the system. The pump is preferably housed in a sealed container 70.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention., Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus to simulate a typhoon comprising, in combination:

a water spraying assembly having a first tube in a circular configuration forming a first ring of an enlarged first diameter, a plurality of inwardly directed spray heads on the first ring and first fluidic coupling components secured to the first ring, a second tube in a circular configuration forming a second ring of a reduced second diameter less than the first diameter with radially extending tubes terminating in a central sprinkler head coupled with respect thereto, second fluidic components secured to the second ring and a generally vertically oriented tube for coupling the fluidic components of the first ring and the second ring;

a shelter assembly for t he spraying assembly, the shelter assembly including a circular wading pool with an annular pneumatic peripheral selectively inflatable wall adapted to receive water within the space circumscribed by the peripheral wall in the lower extent thereof, the wading pool having an upwardly directing selectively inflatable side wall in a generally parabolic configuration with an annular pneumatic peripheral selectively inflatable wall defining a circular opening at the upper extent thereof and transparent panels in the side walls between the upper and lower extents with coupling means to attach the second ring to an intermediate extent of the interior of the side walls and to attach the first ring adjacent to the opening; and a water handling assembly including a pump positionable in the space circumscribed by the peripheral wall with a fluidic line coupled to the fluidic components of the first and second rings to effect the flow of water from the pump to the rings for recirculating the water from the pump to the heads in a continuous and automatic cycle of operation.

* * * * *